United States Patent [19]

Sliva

[11] Patent Number: 4,931,114

[45] Date of Patent: Jun. 5, 1990

[54] METHOD AND APPARATUS FOR PRODUCING ULTRASONICALLY WELDED POMPONS

[76] Inventor: Robert F. Sliva, 807 Patchester, Houston, Tex. 77079

[21] Appl. No.: 684,005

[22] Filed: Dec. 20, 1984

Related U.S. Application Data

[62] Division of Ser. No. 508,731, Jun. 29, 1983, Pat. No. 4,490,419.

[51] Int. Cl.[5] ..... B29C 65/08; D04D 7/06

[52] U.S. Cl. ..... 156/73.1; 156/73.2; 156/166; 156/259; 156/265; 156/517; 156/522; 156/560; 156/580.1

[58] Field of Search ..... 428/4, 5; 156/73.1, 156/73.2, 259, 297, 265, 560, 580.1, 580.2, 583.1, 166, 296, 180, 72, 517, 522; 28/147

[56] References Cited

U.S. PATENT DOCUMENTS

| | | | |
|---|---|---|---|
| 3,017,307 | 1/1962 | Halliburton | 156/72 |
| 4,293,355 | 10/1981 | Wacker | 156/73.2 |
| 4,313,774 | 2/1982 | Arthur | 156/73.1 |
| 4,369,215 | 1/1983 | Offen et al. | 28/147 |
| 4,377,427 | 3/1983 | Francois | 156/73.2 |

*Primary Examiner*—Michael Wityshyn

*Attorney, Agent, or Firm*—Pravel, Gambrell, Hewitt, Kimball & Krieger

[57] ABSTRACT

An apparatus as disclosed by which production of pompons of the inventions comprising a gripping member having a thermoplastic crown piece mating surface to which a plurality of thermoplastic streamers are ultrasonically fused may be utimated which comprises a means for moving a form cluster of streamers into a position intermediate of an ultrasonic welding horn and the crown piece mating surface of a handle or gripping member and a means for contacting and engerizing an ultrasonic welding head with the cluster of streamers so as to fuse the streamers to the crown piece by ultrasonic vibrations.

2 Claims, 2 Drawing Sheets

METHOD AND APPARATUS FOR PRODUCING ULTRASONICALLY WELDED POMPONS

This is a division, of application Ser. No. 508,731 filed June 29, 1983, now U.S. Pat. No. 4,490,419.

BACKGROUND OF THE INVENTION

This invention relates to the manufacture of pompons; a method for making pompons, and an apparatus for producing pompons; more particularly, to pompons whose streamer members and whose handle or gripping member are secured to each other by means of ultrasonic welding.

Heretofore many methods for constructing pompons have been employed. Pompons are constructed by attaching a plurality of streamer members, which constitutes the ribbon or the tuft body, to a shaft, handle or other gripping member. Gripping members are usually made of either plastic or wood and the streamer members are made of some suitable cloth, paper or thermoplastic material for durability. Various methods of attachment of the streamer members to a gripping means are known, but all suffer the disadvantage of being labor intensive and thus time-consuming and inefficient. Conventional methods of pompon construction require a human operator to manipulate the gripping member and streamer members so that each may be properly positioned for attachment by mechanical means.

Many conventional manufacturing methods require that the tuft or streamer body be prefabricated to have a collar member from which the individual streamer members depend. The collar member of the tuft body is placed by a human operator about a handle member and secured thereto by either glue, cement, staple or clamp means. Although other construction methods are also known, they too require a human operator to position the streamer members to the handle member whereupon the human operator effects a mechanical attachment of the streamers to the handle member. All conventional methods of attachment of streamers to handles require attachment by mechanical means. Often in pompons produced by conventional methods the staples become detached or the streamers and handles work loose of the glue or clamp means from the continued stress to which a pompon is subjected during use.

Conventional methods for attachment of tuft bodies to handle members are not suitable to accomplishment by an automated construction method, since each requires the time-consuming process of human placement of the tuft body into position on a gripping member for mechanical attachment. Thus, conventional construction methods are not suitable to the development of an automated assembly procedure for the efficient production of pompons.

SUMMARY OF THE INVENTION

This invention discloses a pompon construction which may be accomplished by an automated construction method, which greatly reduces the amount of human manipulation required to produce a pompon.

The pompons of this invention comprise a gripping member having a thermoplastic crown piece mating surface to which a plurality of thermoplastic streamers are ultrasonically fused.

An apparatus has been devised by which production of pompons of the invention may be automated which comprises a means for moving a formed cluster of streamers into a position intermediate of an ultrasonic welding horn and the crown piece mating surface of a handle or gripping member, and a means for contacting and energizing an ultrasonic welding head with the cluster of streamers so as to fuse the streamers to the crown piece by ultrasonic vibrations.

The process of the invention comprises forming thermoplastic streamer clusters and ultrasonically welding the clusters to a thermoplastic mating surface attached to a handle or gripping member.

OBJECTS OF THE INVENTION

An object of the present invention is to provide a method and apparatus for producing pompons which is automated so that minimum human manipulation of the materials used is required.

A further object is to attach pompon streamers to a pompon gripping member or handle in such a way that the streamers will remain permanently and securely affixed to the handle, regardless of the amount of stress to which the pompon is subjected.

Still another object is to produce a pompon which will withstand normal stress at minimal cost and production time.

DETAILED DESCRIPTION OF THE INVENTION

Figure 1:
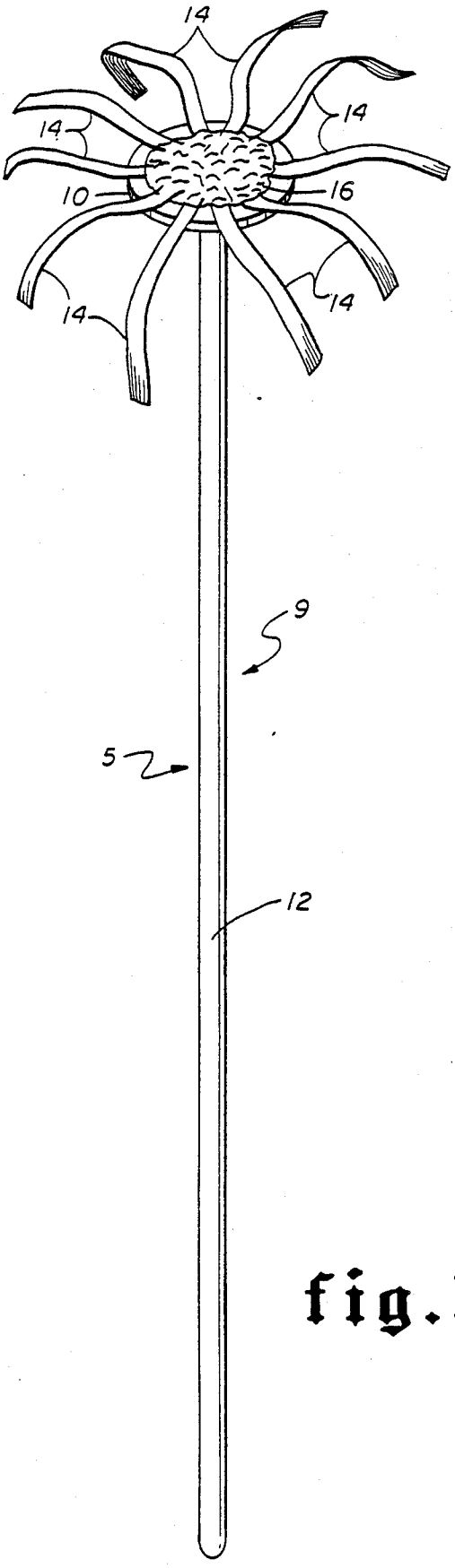
FIG. 1 shows a gripping member with a crown piece attached and streamer members fused to the crown piece in a melted mass at the point of attachment.

Referring to FIG. 1, the pompon 5 of this invention comprises a tuft or streamer body 7 which is secured by ultrasonic welding to a grip member 9. Tuft body 7 is formed of a plurality of individual thermoplastic streamer members 14. For clarity of illustration only portions of a few representative streamer members are illustrated in FIG. 1, but it is to be understood that any number of individual streamer members 14, which may be at any desired length, may be employed to form tuft body 7.

Figure 2:
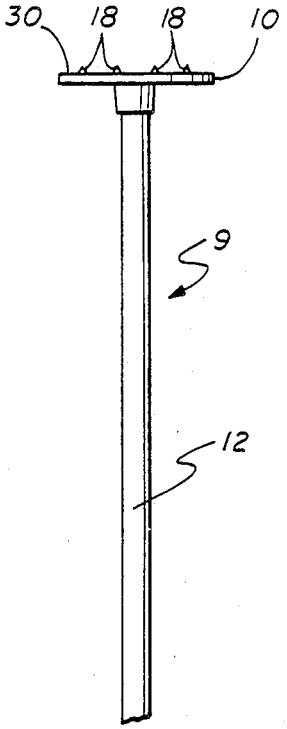
FIG. 2 is a side view of the gripping member with the crown piece attached.

Grip member 9, as best illustrated by FIG. 2, comprises a handle member 12 to one end of which a thermoplastic crown piece 10 is securely affixed. The thermoplastic streamer members 14 forming tuft body 7 are secured to the mating surface 30 of thermoplastic crown piece 10 of grip member 9 by ultrasonic welding. The junction of streamer members 14 to crown piece 10 is accomplished by positioning a bundle or cluster of streamer members 14 upon mating surface 30 of crown piece 10 whereupon ultrasonic vibrations at about a frequency 20k Hz are transmitted through that portion of each streamer member 14 which overlies crown piece 10 and hence into crown piece 10. The vibratory energy is converted to heat causing that portion of the thermoplastic material of each streamer member 14 which overlies crown piece 10 to melt. Further, at least portions of the thermoplastic crown piece 10 which underly streamer members 14 also melt. That portion of each streamer member 14 which overlies crown piece 10 which is melted by ultrasonic vibrations comingles with the melted portion of other tuft body streamer members to form a melt mass 16. Upon formation of melt mass 16, ultrasonic vibration is discontinued, and melt mass 16 solidifies and fuses to the underlying crown piece 10, thus affecting a secure attachment of the unaffected portions of each streamer member 14 to crown piece 10 through melt mass 16.

As noted above, grip member 9 comprises a handle member 12 and a thermoplastic crown piece 10. As illustrated, handle member 12 is preferably an elongated generally tubular element. If desired, a handle member of other design, such as a looped handle which is placed over four fingers of the hand and gripped against the palm, may be used. The handle member may be of any desired shape or material provided only that it is capable of being securely affixed with a crown piece of thermoplastic material.

Figure 3:
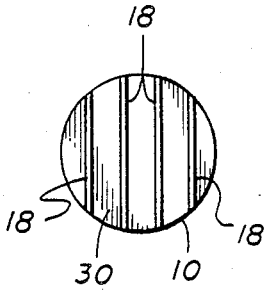
FIG. 3 is a top view of the knurled surface of the crown piece.

Crown piece 10, as illustrated, is preferably disk shaped. Other shapes for crown piece 10 may be employed if desired, provided only that the crown piece be formed to have a suitable mating surface 30 for attachment of melt mass 16. As illustrated by FIGS. 2 and 3, it is preferred that the anterior mating surface 30 of crown piece 10 be formed with a plurality of knurled projections 18. Such projections 18 are preferably elevated 40/1000 of an inch above the mating surface 30. The precise dimensions of projections 18 may be changed depending upon the particular thermoplastic materials employed for the streamer members 14 and crown piece 10, to insure that the streamer materials and projection will each begin to melt at approximatley the same time when sumitted to ultrasonic vibrations. There exists a correlation between the dimensions of such projections 18 and the streamer members 14 to be welded to the crown piece 10 which may readily be determined for any desired combination of thermoplastic materials or volume of a streamer cluster. For most applications a dimension wherein the projections 18 are elevated by 40/1000 of an inch is entirely satisfactory. The streamer members 14 and the material of which such projections 18 are made should have approximately similar or compatible melt indexes so that each will melt to one another at about the same time. Upon application of ultrasonic vibrations to crown piece 10, the knurled projecting surfaces 18 melt more quickly than does the bulk mass of crown piece 10, hence insuring a quick and secure attachment of melt mass 16 to the anterior mating surface 30 of crown piece 10 through fusion with the melt provided by the knurled projections 18.

Grip member 9, comprising handle member 12 and crown piece 10, may be formed as an integral unit as by injection molding of a suitable thermoplastic material, or its individual components may be separately formed and suitably assembled in a separate operation. When formed as an integral unit, then grip member 9 must be fashioned from a thermoplastic materials which is compatible for ultrasonic welding with the thermoplastic composition of which streamer members 14 is formed.

Streamer members 14 may be formed from any thermoplastic and need not be formed of the same thermoplastic material as crown piece 10. Streamer members 14 are preferably secured to crown piece 10 at about the midpoint of streamer members 14, although, streamer members 14 may be secured to crown piece 10 at any point of streamer members 14. The number of streamer members 14 is not critical, but there should be a number of streamer members 14 sufficient, when secured to crown piece 10, to give the desired volume to the tuft body of the pompon. Preferably, streamer members 14 are, before welding, about twice the length of gripping member 12.

Suitable thermoplastic materials from which streamer members 14 and crown piece 10 may be formed include among others, polyvinyl chloride, nylon, fluorocarbons, polyethylene, polystyrene and polypropylene. Streamer members 14 and crown piece 10 may be fashioned of the same thermoplastic material or may be comprised of different thermoplastic materials, provided only that when different thermoplastics are employed that they are compatible for ultrasonic welding.

The apparatus, diagrammatically illustrated by FIG. 4, by which the production of pompons may be automated comprises in its general parts a sheet stock storage rack A, a ribbon cluster forming line B through which thermoplastic sheet stock from rack A is drawn, moved and formed into a continuous cluster of individual ribbon members which are moved into station below an ultrasonic welding horn and above the crown piece of a grip member; a grip member holding means C for holding a grip member in station below an ultrasonic welding horn; ultrasonic welding means D; signaling means E by which movement of sheet stock material through forming line B is stopped, the ultrasonic welding means D is actuated to weld the ribbon cluster to the crown piece of a grip member and upon completion of the weld the movement of sheet material through flow line B is reinitiated; and a shearing means F which is actuated by signaling means E to sever the ribbon cluster to which a grip member has been welded from the continuous sheet material.

Sheet stock storage rack A may comprise any suitable framework 33 within which thermoplastic sheet stock rolls 34 may be positioned for free rotation. Thermoplastic sheet stock 32 is thus freely withdrawable from any given sheet stock roll 34.

Ribbon cluster forming line B comprises a series of rollers, some are tensioning rollers like 36, 38, 40 and 42 to maintain the sheet stock flowing through the line taut, and some are pairs of powered rollers like rollers 48, 50, 58, 62 and 72, 74 by which sheet stock material is drawn through the ribbon cluster forming line B and properly position for ultrasonic welding to a grip member 9. Forming line B contains a ribbon cutting wheel 46 and teflon cutting block 44 which forms the means through which sheet stock 32 is drawn and cut into a plurality of individual ribbon members. Power is supplied directly to rollers 48, 58 and 72 in a manner which is responsive to and coordinated with the operations of ultrasonic welding means D. A power transmission means G, comprising an electric motor 52 which through drive change **52*b* drives an air clutch 54 which by belt 54*a* drives an in/out gear box 55 from which through appropriate chain drives 55*a* power is supplied to rollers 48, 58 and 72. Powered rollers 48, 58 and 72 are preferably of rubber or other resilient composition having a high coefficient of friction. Rollers 48 and 72 are mounted in frictional engagement with rollers 50 and 74, respectively, which rollers 50, 74 are also of rubber or other resilient composition having a high coefficient of friction. Roller 58 is mounted in frictional engagement with a toothed wheel 60, preferably of metallic construction, which hereafter shall be referred to as the crimping wheel. Sheet stock is moved through ribbon cluster forming line B by powered roller pairs 48, 50 and 58, 60 and 72, 74. Ribbon cutting wheel 46 comprises an axle to which is mounted in closely spaced relationship a plurality of thin sharp edged metallic cutting disks. Overlying cutting wheel 46 is a block 44, preferably of teflon, which is provided with a plurality of recesses which correspond to and receive the top portion of each metallic cutting disk of cutting wheel 46. Cutting wheel 46 is provided with constant rotational motion from motor 52 by belt drive 52***a*. As sheet stock passes under block 44 and over ribbon cutting wheel 46 the sheet material is cut into a plurality of individual ribbon elements 32*a*, hereafter called ribboned sheet stock. Ribbon cluster forming line B is also provided with a channeling sleeve 56 which receives ribboned sheet stock 32*a* from rollers 48, 50 and channels the ribboned sheet stock 32*a* into a closely spaced bunched relationship, or what shall be called a ribbon cluster 32*b*, which passes to rollers 58, 60. Channeling sleeve 56 comprises a flat open tray having small perpendicular side walls. End 56*a* of sleeve 56 facing rollers 48, 50 is at least as wide as the width of sheet stock 32 which fed to forming line B. Channeling sleeve 56 narrows towards end 56*b*, the width of end 56*b* being equal to the width desired for the ribbon cluster 32*b*, generally from about three-quarters to about one inch in width. A second channeling sleeve 53 is also provided in forming line B, on the side opposite of roller 58 from main channeling sleeve 56. Second channeling sleeve 53 comprises a hollow tubular element having the same width as is desired for ribbon cluster 32*b*, generally from about three-quarters to about one inch in width. Second channeling sleeve 53 extends in length from a point just adjacent to roller 58 into a point just adjacent to the ultrasonic welding station of ultrasonic welding means D.

The ultrasonic welding means D may comprise any of the commercially available ultrasonic assembly units, such as for example, a Branson Model 8400 marketed by Branson Sonic Power Company. Preferably, the ultrasonic welding means D employed should be an integrated welder. Integrated welders include a power supply, controls, indicators, an actuator, and an electronic programmer which automatically actuates the power supply and controls ultrasonic exposure and pneumatic sequences. Integrated welders are housed in compact housings which are supported by an assembly stand. As diagrammatically illustrated in FIG. 4, the ultrasonic welding means D comprises an ultrasonic welder control housing 70, ultrasonic welding horn 68 and assembly stand 69. Activator switch 66 is illustrated as mounted to assembly stand 69. When activator switch 66 is tripped, in a manner to be explained subsequently, it signals the electronic programmer of the ultrasonic welding means D which then initiates a welding cycle. Upon initiation of a welding cycle, air clutch 54 is pneumatically disengaged by a pneumatic signal generated by the electronic programmer of welding means D, and flow of sheet stock material through forming line B is stopped. Upon completion of a welding cycle a pneumatic signal is generated by the electronic programmer and causes air clutch 54 to reengage and flow of sheet material through forming line B is resumed. FIG. 4 diagrammatically illustrates as broken lines the electronic and pneumatic signaling means E by which sequencing control signals are conveyed through the apparatus.

A grip member holding means C is positioned within flow line B at a point just below the welding station of ultrasonic welding means D. Holding means C may be any device which will hold an individual grip member 9 in station below welding horn 68 of welding means D such that crown piece 10 of grip member 9 will underlie and contact the streamer cluster 32*b* which passes over such station. The holding means C may be a slotted platform, wherein the holding slot is of a width slightly greater than handle member 12 and smaller than the diameter of crown piece 10 which comprise grip member 9. Wherein the holding means C comprises a slotted platform, the platform is secured at a point within the framework which supports the components of forming line B which underlies the streamer cluster 32*b* and welding horn 68 and is positioned such that the slot opens on an angle towards roller 72.

Finally, the product end of forming line B is provided with an automatic shear means F which, upon activation of a welding cycle wherein flow of materials through line means B is stopped, is itself actuated and shears that portion of the ribbon cluster to which a grip member 9 has been previously welded, free from the ribboned sheet stock material.

Figure 4:
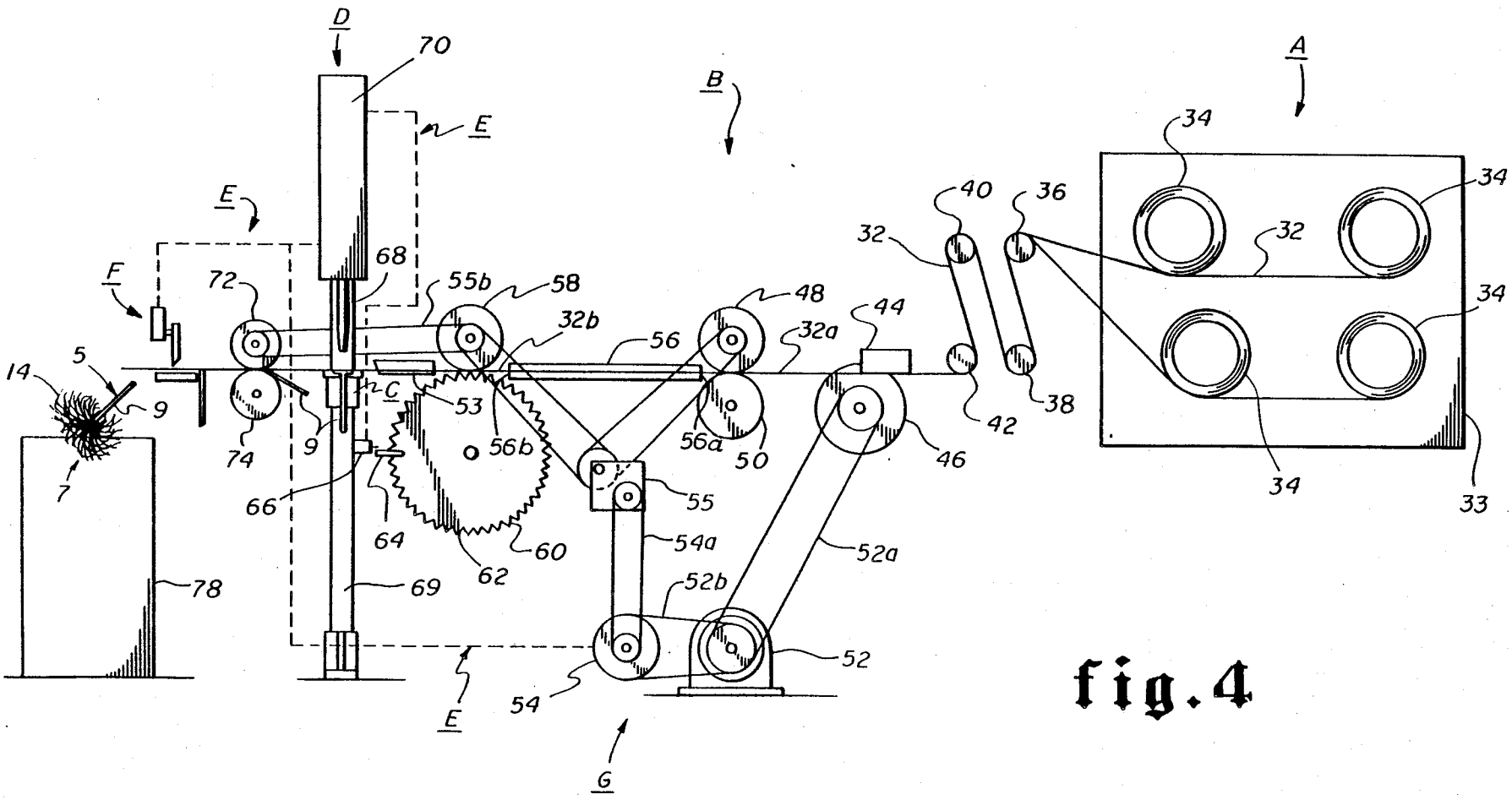
FIG. 4 is a diagrammatic representation of an apparatus by which the streamer clusters are automatically formed and then ultrasonically welded to the crown piece mating surface of a gripping member.

The apparatus diagrammatically illustrated in FIG. 4 operates in accordance with the following description. Thermoplastic sheet stock 32 is drawn from each sheet stock roll 34 and directed around tensioning rollers 36, 38, 40 and 42 which maintains sheet stock 32 in taut relationship. Sheet stock 32 is drawn from the last tensioning roller 42 under cutting block 44 and across cutting wheel 46. Constant rotation is provided to cutting wheel 46 by motor 52 through belt drive 52*a*. The plurality of cutting disks forming cutting wheel 46 cuts sheet stock 32 passing thereover into a plurality of ribbons, namely ribbon sheet stock 32*a*. The ribboned sheet stock 32*a* leaving cutting wheel 46 is passed between powered rollers 48, 50 and through channeling sleeve 56 by which the ribboned sheet stock 32*a* is funneled or formed into a ribbon cluster 32*b*. The ribbon cluster 32*b* is passed between powered rollers 58 and crimping wheel 62, wherein during passage over crimping wheel 62 crimp is imparted to the ribbon members comprising ribbon cluster 32*b*. Crimping of the ribbon members helps to impart extra body or fluffiness to the pompon tuft body 7 which is ultimately formed from the ribbon cluster 32*b*. The crimped ribbon cluster 32*b* leaving crimping wheel 60 is passed through a second channeling sleeve 57 which insures that the individual ribbon members of ribbon cluster 32*b* are maintained in a tightly bunched relationship as they pass over a grip member 9 held in station below welding horn 68 by grip member holding means C.

Crimping wheel 60 is provided with a trip arm 64 which has a plane of rotation which brings trip arm 64 into contact with actuator switch 66 whenever crimping wheel 60 completes one cycle of rotation. When actuator switch 66 is tripped it generates a signal which activates the internal programmer of welding means D which begins a welding cycle. The programmer of welding means D generates a pneumatic signal which disengages air clutch 54, stopping power transmission to rollers 48, 58 and 76, thus stopping movement of sheet stock through forming line B. Thereafter, in conformance with the programmer control, welding horn 68 moves down into station into contact with that portion of streamer cluster 32*b* which overlies the crown piece 10 of a grip member 9 held in station by holding means C. The welding horn 68 is then energized and transmits ultrasonic vibrations through that portion of ribbon cluster 32*b* which overlies crown piece 10 and thus produces a meld fusion of ribbon cluster 32*b* to crown piece 10 of grip member 9. Typically, the ultrasonic welding means D is programmed to continue ultrasonic vibations for a duration of about one to about two seconds and add a contact pressure of about twenty to about forty psi. Upon completion of the ultrasonic weld, the programmer retracts welding horn 68 to its standby position and causes a pneumatic signal to be generated which reengages air clutch 54, resuming flow of sheet flow material through forming lines B. As may be appreciated from the above description, the end to end length of the ribbon members 14 which form tuft body 7 of pompon 5 produced in this apparatus is directly related to the diameter of crimping wheel 60. Thus, pompons having any desired length of streamers may be formed by changing the diameter of crimping wheel 60.

The end of the ribbon cluster to which a grip member 9 is now welded is passed between powered rollers 72, 74. When air clutch 54 is reengaged, power to rollers 72, 74 is resumed and the ribbon cluster is drawn therebetween by frictional engagement. Since rollers 72, 74 are of rubber or other resilient composition, the grip member 9 welded thereto is drawn from holding means C and easily passes between rollers 72, 74 without difficulty. The ribbon cluster 32*b* to which gripping member 9 has been welded is passed to automatic shear means F which is also actuated by actuator signal 66 and, upon the next welding cycle, automatic shear means F operates to shear the ribbon cluster free from the continuous sheet stock. The completed pompon 5 thereupon falls free into a storage receptable 78.

Persons having ordinary skill in the art may appreciate that various changes and modifications may be made to the pompon construction and method for making same which are described above which would not depart in scope or spirit from that which is claimed hereafter.

I claim:

1. A process for producing pompons, comprising the steps of:

cutting thermoplastic sheet material into a plurality of streamer members;

forming said plurality of streamer members into a streamer cluster;

holding a pompon gripping member having a crown piece mating surface in station below an ultrasonic welding horn;

moving said streamer cluster into station above said crown piece mating surface of said gripping member at a position intermediate of said mating surface and said ultrasonic welding horn;

actuating said ultrasonic welding horn to move into contact with said streamer cluster;

energizing said ultrasonic welding horn upon contact with said streamer cluster to fuse said streamer cluster to said mating surface;

de-energizing said ultrasonic welding horn upon completion of fusion of said streamer cluster to said mating surface;

moving said gripping member having said streamer cluster fused to said mating surface thereof out of station below said ultrasonic welding horn; and severing said streamer cluster to which said gripping member had been fused.

2. An apparatus for producing pompons comprising:

a means for cutting thermoplastic sheet material into a plurality of streamer members;

a means for forming said plurality of streamer members into a streamer cluster;

a means for holding a pompon gripping member having a crown piece mating surface in station below an ultrasonic welding horn;

a means for moving said streamer cluster into station above said crown piece mating surface of said gripping member at a position intermediate of said mating surface and said ultrasonic welding horn;

a means for actuating said ultrasonic welding horn to move into contact with said streamer cluster;

a means for energizing said ultrasonic welding horn upon contact with said streamer cluster to fuse said streamer cluster to said mating surface;

a means to de-energize said ultrasonic welding horn upon completion of fusion of said streamer cluster to said mating surface;

a means for moving said gripping member having said streamer cluster fused to said mating surface thereof out of station below said ultrasonic welding horn; and a means for severing said streamer cluster to which said gripping member has been fused.

* * * * *